US005803596A

United States Patent [19]

Stephens

[11] Patent Number: 5,803,596

[45] Date of Patent: Sep. 8, 1998

[54] METHOD AND APPARATUS FOR HIGH CAPACITY PRODUCTION OF FINISHED AQUEOUS FOAM WITH CONTINUOUSLY ADJUSTABLE PROPORTIONING

[76] Inventor: Patrick J. Stephens, 1276 Chuckanut Dr., Bellingham, Wash. 98225

[21] Appl. No.: 650,919

[22] Filed: May 17, 1996

[51] Int. Cl.[6] ..... B28C 7/04; A62C 5/02

[52] U.S. Cl. ..... 366/10; 366/16; 366/51; 366/160.3; 169/15; 261/27; 261/DIG. 26

[58] Field of Search ..... 366/3, 10, 11, 366/14, 15, 51, 101, 16, 160.1–160.3, 182.2, 190, 8, 152.1; 261/27, DIG. 26; 169/14, 15

[56] References Cited

U.S. PATENT DOCUMENTS 4,298,288 11/1981 Weisbrod ..... 366/11 X
5,102,228 4/1992 Vine-Lott ..... 366/3
5,174,383 12/1992 Haugen et al. ..... 169/15
5,232,052 8/1993 Arvidson et al. ..... 261/DIG. 26
5,419,632 5/1995 Stephens ..... 366/3
5,494,112 2/1996 Arvidson et al. ..... 169/14 X

*Primary Examiner*—Charles E. Cooley
*Attorney, Agent, or Firm*—Todd N. Hathaway

[57] ABSTRACT

An apparatus for continuous production of finished foam material, in which the proportions of the constituents are monitored and continuously adjustable during operation of the machine. The liquid components are metered by positive-displacement, progressive-cavity, screw-type pumps driven by variable speed motors. Rates of flow are monitored by flow meters, and the relative proportions of the constituents can be closely adjusted by varying the speeds of the pump drive motors and observing the flow meter readouts. The finished foam produced by the apparatus may be used, for example, for the preparation of foamed cement grouts or for fighting fires.

42 Claims, 4 Drawing Sheets

WATER SUPPLY TANK
124
101
FOAM CONCENTRATE TANK
104
106
PRE-MIXED FOAM SOLUTION TANK (ALTERNATE)
54
METERING PUMP SPEED CONTROLS
108
110
136
138
182
144
52
122
116
46
50
148
72
178
74
70
66
111
64
86
102
114
112
126
WATER METERING PUMP
CONCENTRATE METERING PUMP
76
GROUT METERING PUMP
32a
146
43
100
FOAM GENERATOR CONTROLS
144
142
45
140
130
56
63
62
COMPRESSED AIR TANK
60
78
80

METHOD AND APPARATUS FOR HIGH CAPACITY PRODUCTION OF FINISHED AQUEOUS FOAM WITH CONTINUOUSLY ADJUSTABLE PROPORTIONING

BACKGROUND OF THE INVENTION a. Field of the Invention

The present invention relates generally to apparatus for production of aqueous foam materials, and, more particularly, to a method and apparatus for high volume production of aqueous finished foams in which the proportions of the components of the foams can be continuously monitored and adjusted during operation of the systems.

b. Background

Aqueous finished foam materials have many applications, amongst which are preparation of foamed cement grouts and use as fire fighting agents. Typically such foam materials have a cellular, micro-bubble structure formed principally from the following constituents: air, water, and foam concentrate. These constituents are mixed in specific proportions, and sometimes with other components or additives, to produce a foam material having the appropriate fluidity, density, and other characteristics for the intended use.

Numerous foam concentrate materials are known to those skilled in the relevant art. Formerly, many of these foam concentrate materials were based on animal protein by-products. More recently, however, these have been largely replaced by synthetic-based products. In layman's terms, these foam concentrates resemble surfactants, and are supplied in bulk in drums or similar containers. An exemplary product of this type is "Mearl Geocell Foam Liquid" foam concentrate, available from the Mearl Corporation, Roselle Park, N.J. Similar products are available from Elastizell Corporation of Ann Arbor, Mich.

The foam concentrate material is mixed with water in a suitable proportion to form an aqueous foam solution; a typical example is a 2½% aqueous foam solution, i.e., 2.5 parts foam concentrate to 97.5 parts water. This foam solution is then blended with air during passage through a medium or structure which produces the bubble structure; for example, blending may take place in a foam nozzle or in passage through a chamber filled with beads or other medium.

Since the characteristics of the finished foam material—e.g., its density, fluidity, bubble strength, amongst others—depend primarily on the proportions of its constituents, i.e., the air, water, and foam concentrate, precise control over these proportions is critical for consistent production of material having consistent qualities. Some existing foam generation systems have only rudimentary controls and are therefore completely incapable of producing foam having consistent quality. Other systems provide somewhat more consistent proportioning, but exhibit other deficiencies. A notable example of this type is the AutoFoam™ foam generator unit available from the Mearl Corporation (e.g., the Mearl model AFS-2H-20V). These units are equipped with pumps for drawing foam concentrate from a drum and supplying this to the unit, where it is mixed with water and air to produce the finished foam. As compared with some other systems, these units provide a reasonably consistent output quality. If, however, it becomes necessary to adjust or correct the quality of the foam during operation, this is difficult or impossible to do; for example, the Mearl AutoFoam™ units (which are comparatively small machines) employ gear pumps which are belt driven from single-speed electric motors, so that the rates at which they operate cannot be significantly changed without partially disassembling the machine and changing the sizes of the drive pulleys. Also, the foam solution is forced up out of storage tank using air pressure, and the main control for the air/foam solution ratio is a valve in an air bypass line; this arrangement permits only very minor changes in the proportions of the air and foam solution and precise adjustments are essentially impossible.

The foam output rate, in turn, is controlled on the Mearl Auto Foam™ unit using a simple gate valve on the output line, which is opened and closed to give more or less product; however, when this is done, the quality of the product varies, because of damage to the bubble structure and because the back pressure affects the air flow and solution feed rates. Furthermore, there is no way for the operator to monitor the actual amounts of the constituents which are being combined by the machine.

As a result, prior art foam generators of this type are of very limited use in a field environment, where it is frequently necessary to adjust the output speed, density or other characteristics of the finished foam to meet changing environmental conditions.

Another, related problem is that prior art foam generating systems have simply been incapable of supplying very large volumes of finished foam material while maintaining consistent output quality. Previous systems have generally needed only very limited capacities; for example, in the field of cellular cements, a typical application has been to prepare a small quantity of foam which is then dumped into a relatively small tub for mixing with concrete which is then poured to form a floor or roof panel.

Recently, however, certain cellular cement/grout plants have been developed which operate continuously and on a vastly larger scale. For example, Applicant has developed certain very high capacity cellular grout mixing plants which produce foam cement grout at heretofore unavailable rates, for filling massive underground cavities, and which demand a continuous, high volume supply of finished foam to support their operation. Moreover, these plants are capable of operating at variable speeds, and therefore require that the finished foam material be supplied at variable rates, but without unacceptable inconsistencies in quality. Apart from the sheer incapacity of the prior art foam generators to produce at these levels, their inability to monitor and precisely control the proportioning of the foam constituents would become greatly magnified at such high output rates; in short, a "glitch" or inaccuracy might produce just a small amount of bad foam when operating at small capacities, but a similar error occurring when operating at greatly elevated rates would produce much more bad foam and/or cellular concrete.

Another example where the rapid production of very large quantities of high quality foam is needed is in connection with fire fighting, especially for use in combatting aircraft crash fires and other major conflagrations.

Accordingly, there exists a need for a method and apparatus for the continuous production of large volumes of aqueous finished foam with consistent, precisely controlled quality, and with the capability of being able to monitor the proportions of the constituents of the foam material and to precisely adjust these on a continuous basis during operation of the system.

SUMMARY OF THE INVENTION

The present invention has solved the problems cited above, and is an apparatus for continuous production of the finished foam material. Broadly, this apparatus comprises: (a) blending means for combining a flow of aqueous foam solution with a flow of compressed air so as to form a finished foam material; (b) an air line for supplying a substantially continuous flow of compressed air to the blending means; (c) a positive displacement metering pump for supplying a substantially continuous flow of the aqueous foam solution to the blending means, the metering pump being configured to deliver a rate of flow which is directly proportional to its rate of operation; (d) means for monitoring a rate of flow at which the compressed air is supplied to the blending means; (e) means for monitoring a rate of flow at which the aqueous foam solution is supplied to the blending means by the metering pump; (f) means for selectively adjusting the rate of flow of the compressed air; and (g) speed control means for variably adjusting the rate of operation of the metering pump so as to proportionally adjust the rate of flow in which the foam solution is delivered to the blending means; (h) whereby the rates at which the air and aqueous foam solution are delivered to the blending means are variably adjustable so as to produce a finished foam material having selected proportions thereof. Preferably the solution metering pump comprises a positive-displacement, progressive-cavity, rotor-stator pump.

The means for monitoring the rate of flow of the foam solution may comprise a flow meter for providing a continuous reading of the rate of flow of the foam solution. The means for monitoring the rate of flow of the compressed air, in turn, may comprise a flow meter mounted in the air line for providing a continuous reading of the rate of flow of the compressed air.

The means for variably adjusting the rate of operation of the foam solution metering pump may comprise a variable speed hydraulic drive motor operably connected to the metering pump, and a speed adjustment valve for adjusting a flow of hydraulic pressure to the drive motor so as to variably control the speed thereof. There may also be a cutout valve connected in series with the speed adjustment valve, so that the solution metering pump can be secured if started without disturbing the speed adjustment valve.

The apparatus may further comprise storage means for supplying premixed foam solution to the solution metering pump, or means for mixing foam concentrate from water in selected proportions to produce the foam solution and supply this to the solution metering pump. The means for mixing the foam concentrate and water in selected proportions may comprise a positive displacement foam concentrate metering pump for supplying a substantially continuous flow of foam concentrate to the intake side of the solution metering pump, the concentrate metering pump being configured to deliver a rate of flow which is directly proportional to its rate of operation, a water line also connected to the intake side of the solution metering pump, for supplying a substantially continuous flow of water thereto; means for monitoring a rate of flow at which the foam concentrate is supplied by the concentrate metering pump; and speed control means for variably adjusting the rate of operation of the concentrate metering pump so as to proportionally adjust the rate of flow at which the foam concentrate is delivered to the solution metering pump; whereby the selected proportions in which the foam concentrate and water are mixed to produce the foam solution are selectively adjustable by selectively adjusting the relative rates of operation of the foam concentrate and solution metering pumps.

The apparatus may further comprise means for mixing the finished foam with cement slurry in selected proportions so as to form a cement grout on a substantially continuous basis. The means for mixing the finished foam with the cement slurry may comprise a positive displacement grout metering pump for receiving and mixing the finished foam and cement slurry on a continuous basis, the grout metering pump being configured to deliver a rate of flow which is directly proportional to its rate of operation; means for monitoring the rate of flow at which the cement slurry is drawn by the grout metering pump; and speed control means for variably adjusting the rate of operation of the grout metering pump so as to proportionally adjust the rate of flow at which the cement slurry is drawn by the pump relative to the rate at which the finished foam is supplied thereto from the foam blending means, so as to produce a foam cement grout having selected proportions of the finished foam and cement slurry. Preferably, the grout metering pump comprises a positive displacement progressive-cavity, rotor-stator pump with first and second spaced apart injection points on its intake side for the finished foam and cement slurry. Preferably, the injection point for the finished foam is positioned a spaced distance downstream of the injection point for the cement slurry on the intake side of the pump, the spaced distance being sufficient to prevent the finished foam from backing up to the slurry injection point during operation of the pump.

Alternatively, the apparatus may further comprise means for directing a substantially continuous flow of the finished foam material onto the side of a fire. For example, the means for directing the flow of finished foam onto the fire may comprise a hose member having a first end connected to the output side of the foam blending means, and a nozzle member connected to the second end of the hose member for projecting the flow of finished foam onto the fire.

DETAILED DESCRIPTION a. Overview

Figure 1:
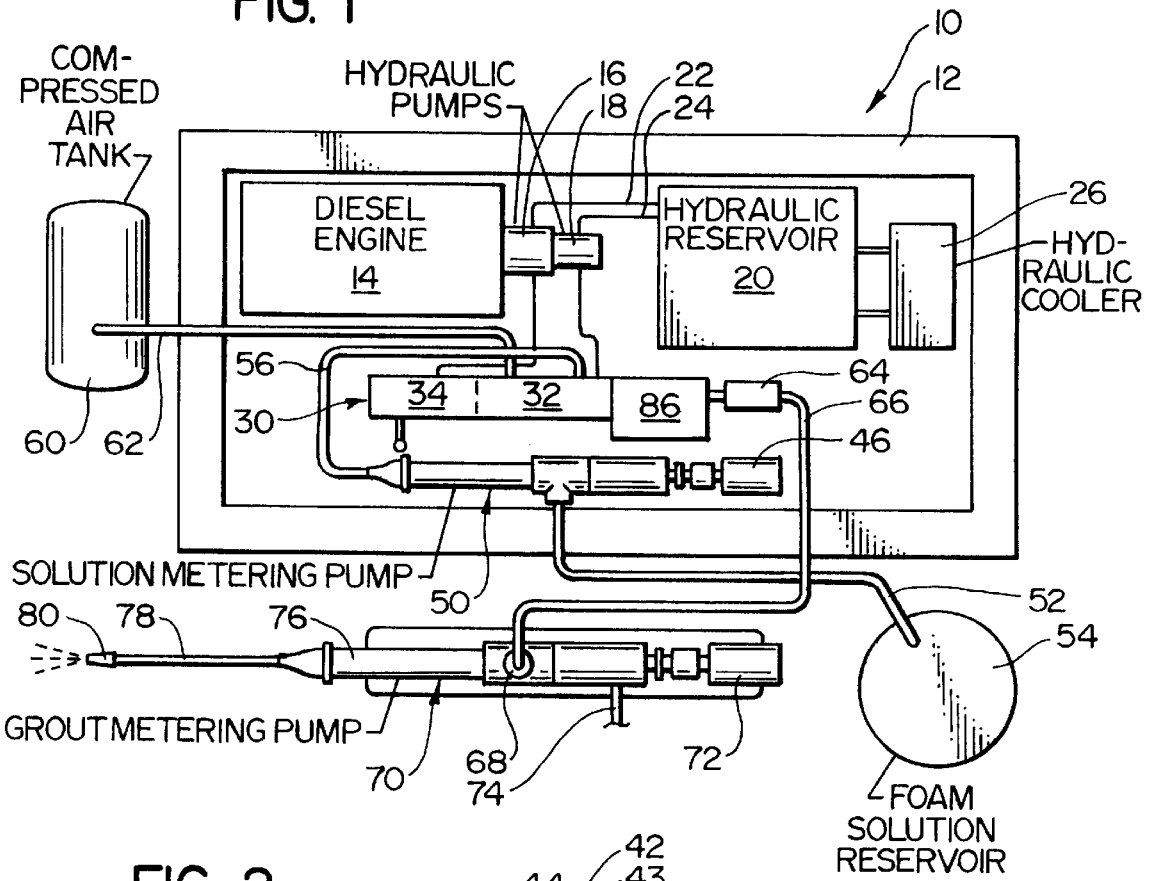
FIG. 1 is a simplified plan view of an aqueous foam mixing and generating apparatus in accordance with the present invention.

FIG. 1 provides a plan view of a foam generating apparatus 10 in accordance with the present invention. As can be seen, the entire mixing and generation apparatus is configured to be mounted on a single skid frame 12, so as to be readily transportable to a field site.

In the embodiment which is illustrated, the various metering pumps are hydraulically operated, although it will be understood that in other embodiments some or all of these may be driven by electric motors or other drive means.

Accordingly, as can be seen in FIG. 1, the primary power source for the apparatus 10 is a diesel engine 14 which drives first and second hydraulic pumps 16, 18. Pumps 16 and 18 draw hydraulic fluid from reservoir tank 20, through suction lines 22, 24, and a fan equipped hydraulic cooling assembly 26 is provided to maintain the fluid temperature within operating parameters.

The hydraulic output from pumps 16 and 18 is provided to a control panel assembly 30. The control panel assembly includes a foam generator control panel 32, which will be described in greater detail below. Also, in the particular embodiment which is illustrated—in which the finished foam is mixed with cement slurry to form a foamed cement grout—the control assembly 30 includes a grout control section 34 adjacent to the foam control section. As can be seen in FIG. 1, the output from the smaller hydraulic pump 18 is connected to the foam control section of the control panel, while the output from the larger hydraulic pump 16 operates the grout side of the system.

Foam control panel 32 includes a combined solution-air on-off control 40, a foam solution adjustment section 42, and a compressed air section 44. The pump control section simultaneously opens the air supply and energizes the hydraulic drive motor 46 of a positive displacement, progressive cavity, rotor-stator solution metering pump 50. Pumps of this type, which include, for example, those available under the trademark "MOYNO" from Robbins & Meyers, Inc., Dayton, OH, have an output rate which is directly proportional to the rate of rotation of the drive shaft. This is important in the present invention because very precise, predetermined adjustments in the flow rate can be affected by increasing or decreasing the speed of the pump drive by a predetermined amount. Although pumps of Moyno™ type are preferred for use in the present invention, owing to their high degree of accuracy and reliability, roller pumps, gear pumps and/or other similar types of pumps driven by variable speed motors may be suitable for use in some embodiments of the present invention.

The suction line 52 of pump 50 is connected to a foam solution reservoir 54, from which the pump draws a metered amount of premixed water-foam concentrate solution (e.g., a 4% foam concentrate solution). The foam solution flow is "metered"0 in the sense that it is precisely controlled by adjustment the speed of the pump drive motor 46, using a speed adjustment knob 55 in solution control section 42.

The foam solution is outputted from metering pump 50 to the foam solution section 42 of the foam control panel, via line 56. A flow meter 43 in the control panel provides a continuous indication of the solution flow rate. Compressed air, in turn, is supplied to the compressed air section 44 of the panel from storage tank 60, via compressed air line 62 including a regulator valve and flow meter 45. An oil separator 63 is provided to eliminate any oil from the compressed air which might cause deterioration of the bubble structure of the foam material. The controls in this section enable the air to be supplied in an infinitely adjustable, metered amount to a venturi assembly in which the compressed air and foam solution are combined, and pass therefrom through a foam conditioner 64.

From the foam conditioner 64, the finished foam is discharged through foam hose 66. The finished foam may be directed from here to any desired site, depending on how it is to be used. In the embodiment which is shown in FIG. 1, the foam discharge hose 66 is connected to the foam intake fitting 68 of a grout metering pump 70. Pump 70 preferably is another positive displacement, rotor-stator pump of the Moyno™-type, and is driven by a second hydraulic motor 72. A cement slurry line 74 is also connected to the intake side of pump 70, upstream of the foam intake fitting 68. The foam and cement slurry are mixed within the body 76 of the pump and within the first portion of the grout line 78, before being discharged from nozzle 80 into an area which is to be filled with the material.

Because the flow rate of the Moyno™-type pump 70 is, like that of pump 50, directly proportional to the speed of the drive motor, the flow rates of the cement slurry on the intake side and the foamed cement grout mixture on the output side can be precisely metered. The on/off valve 82 and speed control 84 for the grout pump 70 are contained in the grout control panel 34 of control assembly 30.

Figure 2:
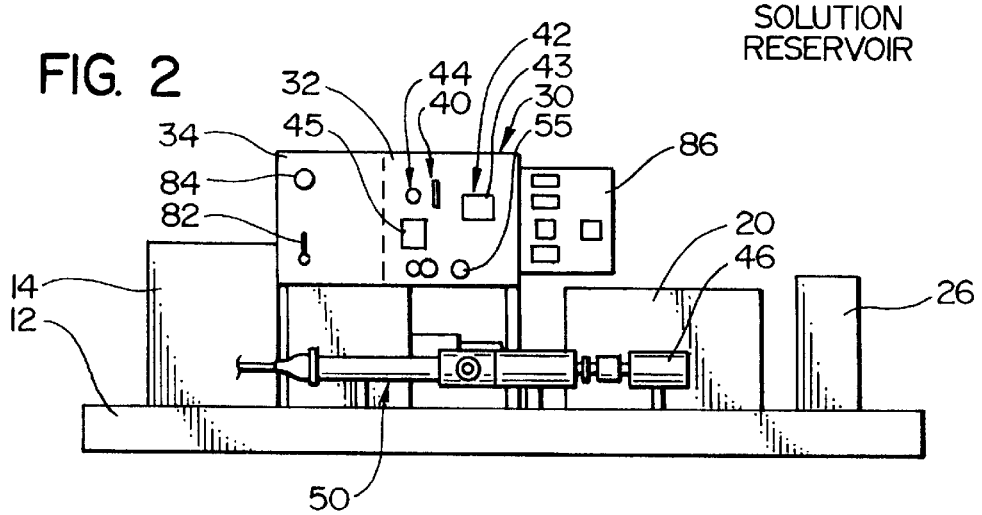
FIG. 2 is an elevational view of the apparatus of FIG. 1.
Figure 3:
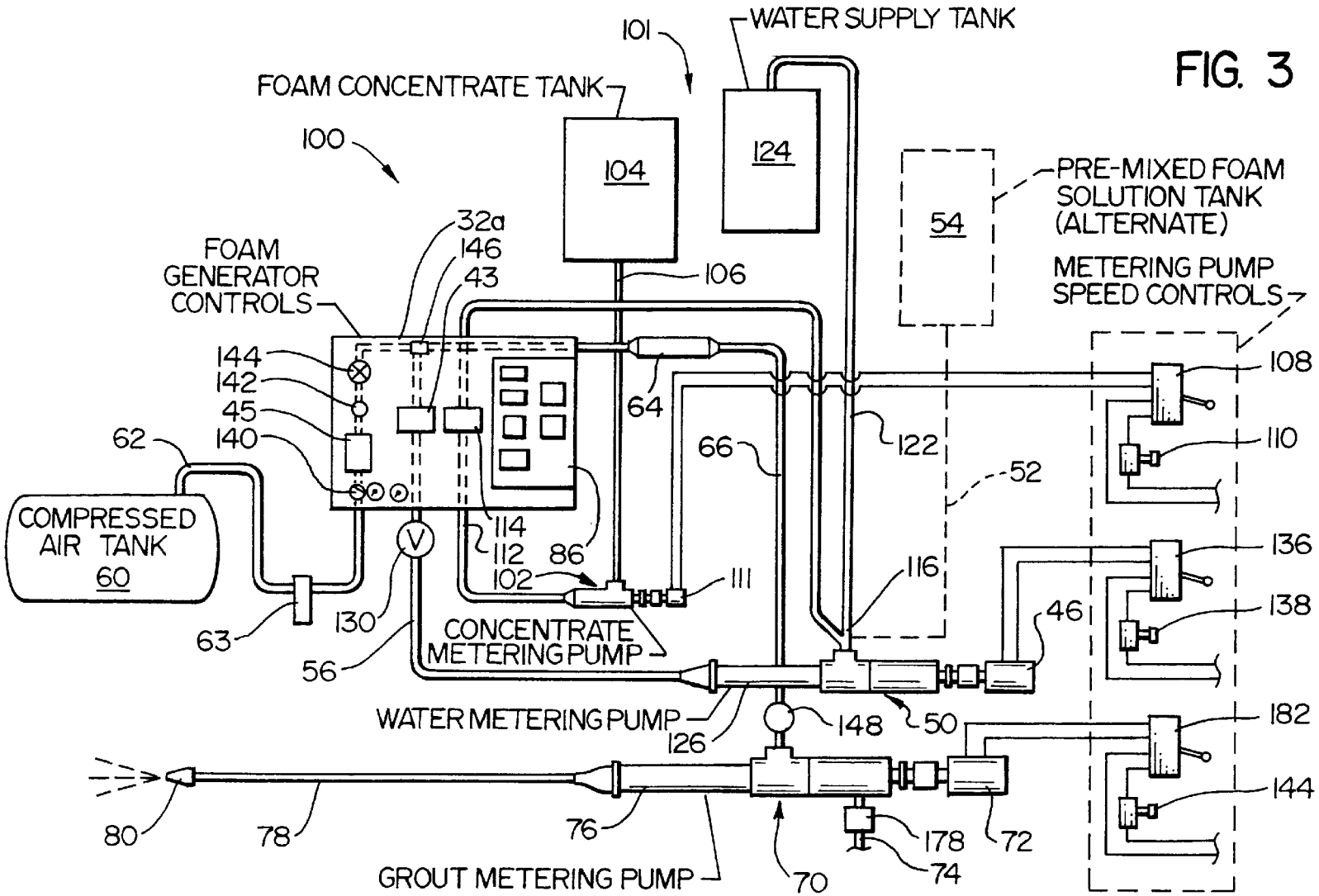
FIG. 3 is a schematic view of the control, mixing and proportioning components of the apparatus shown in FIGS. 1–2, with the exception that the pre-mixed foam solution tank shown in FIGS. 1–3 is shown replaced by mixing system for combining water and foam concentrate in metered amounts to provide the foam solution supply.

As was noted above, the monitoring and control components of the apparatus are contained in the control assembly 40. Specifically, as is shown in FIGS. 2 and 3, the control assembly includes a monitoring panel 86 which is co-located with the foam and grout control panels 32, 34. As will be described in greater detail below, the display panel includes tachometer readouts and flow meters for each of the pumps/fluid constituents in the system. This allows the operator to check the flow rates of the constituents for correct proportioning, adjust the speed of the appropriate pump or pumps upwardly or downwardly using the speed control and watching the tachometer readout, and then verify the adjusted flow rates on the flow meter readouts.

From the foregoing, it will be understood that the present invention provides infinitely adjustable control over the following functions:

(1) the dilution of the foam solution (i.e., the water:foam concentrate ratio);

(2) the density of the finished foam (i.e., the air:foam solution ratio); and (3) the finished foam output rate.

Moreover, although all of these functions are interrelated, each can be adjusted during operation of the apparatus without causing the others to move outside of their assigned parameters.

b. Solution Metering System

In the particular embodiment which is shown in FIGS. 1–2, the foam solution is provided in a premixed form from tank 54; in other words, the water and foam concentrate are premixed to a selected concentration (e.g., 96:4) at a separate location before the tank is filled.

Figure 4:
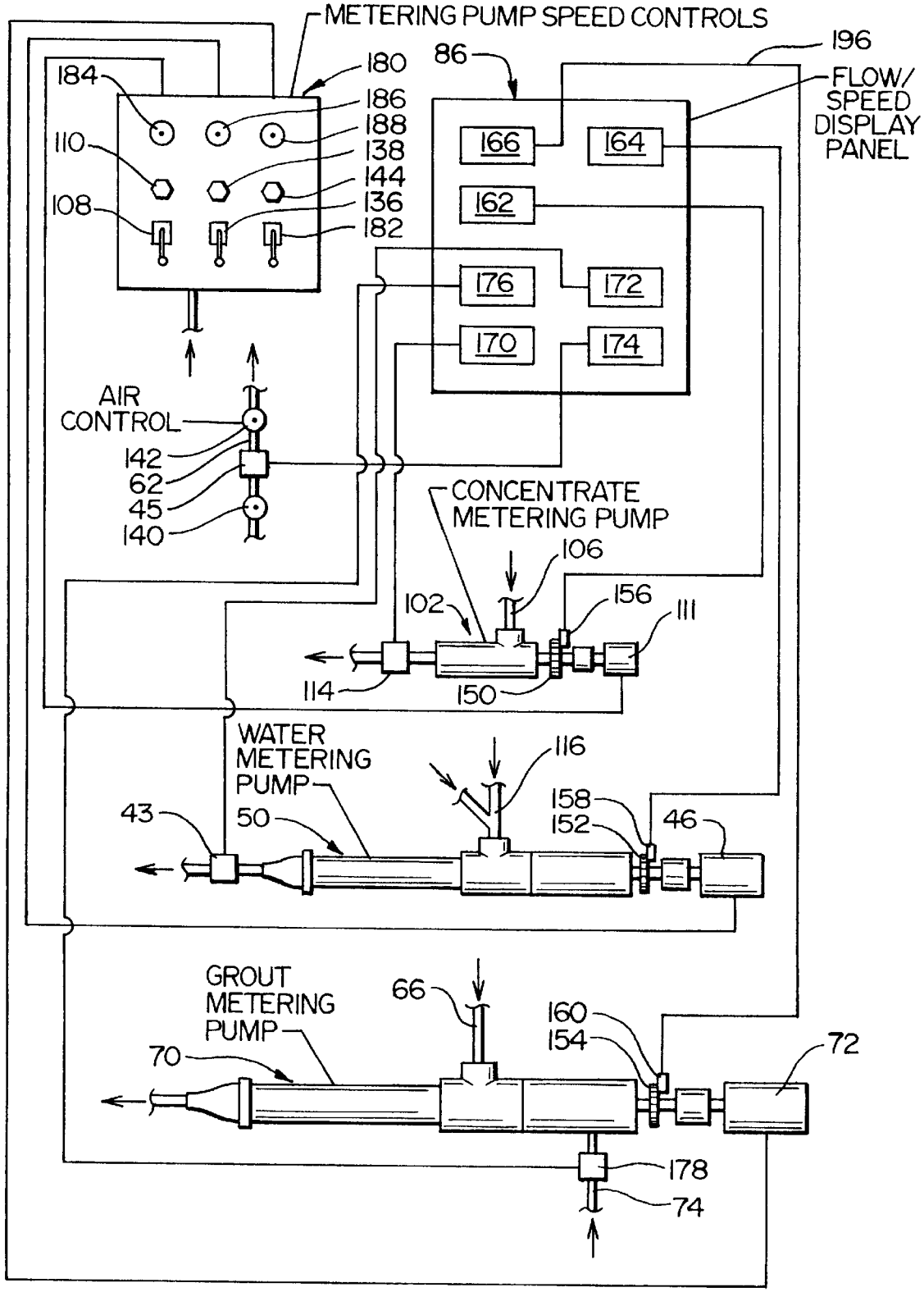
FIG. 4 is a schematic view, somewhat similar to FIG. 3, showing portions of the control, mixing, and monitoring systems of the apparatus in greater detail.

FIGS. 3–4, in turn, show an apparatus 100 which is essentially the same as that shown in FIGS. 1–2 (and in which, therefore, like reference numerals refer to like elements), except that the batch-type solution supply tank (shown for reference by the broken line image in FIG. 3) is replaced by a metering and control circuit 101 which mixes foam concentrate with water to form the foam solution on a continuous basis.

Accordingly, as can be seen in FIGS. 3–4, there is a third Moyno™-type metering pump 102 which draws foam concentrate from a drum or tank 104, via concentrate line 106. The concentrate metering pump 102 is provided with its own on/off valve 108 and speed adjustment valve 110 for drive motor 111, corresponding to the on/off and speed adjustment controls of the other metering pumps described above. The concentrate output line 112 is routed through a flow meter 114 in control assembly 32*a* and to a wye fitting 116 on the intake side of the solution metering pump 50 (which is the same place the premixed solution supply is connected in the embodiment which is shown in FIGS. 1–2), and the water line 122 from tank 124 is connected to the other side of the wye fitting.

The foam concentrate and water are mixed within the body of the pump 50 and discharged through line 56. This passes through the flow meter 43 in control assembly 42. A needle valve 130 is mounted in line 56 upstream of the flow meter (see FIG. 2); this "smooths out" the slight fluctuations on the output side of pump 50, so as to provide more accurate flow readings.

Dilution of the foam solution, i.e., the water:foam concentrate ratio, is thus controlled by adjusting the relative operating rates of the concentrate and solution metering pumps 102 and 50. The operating speed of the solution metering pump 50 is set to provide the desired output rate based on the amount of solution which will be required to produce the finished foam. The bulk of the foam solution (e.g., 96%–97.5%) is water, which is simply received under a constant, low head of pressure from tank 124. The flow rate of the foam concentrate constituent is then adjusted by increasing/decreasing the speed of the concentrate metering pump 102, using speed adjustment valve 138. Thus, if a lower dilution rate is desired, then the speed of the concentrate pump is increased, and vice versa. For example, in terms of relative operating rates, the solution pump may be set at 10 gpm and the concentrate pump may be set at 0.4 gpm in order to produce a 4% concentrate solution. By comparing the concentrate flow rate indicated by flow meter 114 with the combined concentrate-water solution flow rate indicated by meter 43, the operator can verify that the correct dilution rate has been achieved, and make adjustments as necessary.

Should a demand occur for an increased or decreased amount of foam solution having the same dilution rate, this can be done by simultaneously increasing/decreasing the drive speeds of the two metering pumps 102, 50 (the motor speed controls are co-located, as shown in FIG. 4), while constantly comparing the concentrate and solution flow rates to insure that these maintain the correct proportional relationship.

c. Foam Formation System

As was noted above, the solution outputted from pump 50 is combined with air supplied from reservoir 60 to form the finished foam material.

Like the other constituents, the air is supplied at a controllable, infinitely adjustable rate. In order facilitate precise metering of the air component, a pressure regulator valve 140 is mounted in line 62 upstream of the flow meter 45 and air metering valve 142. A cutout valve 144 is also mounted in the air supply line.

As can be seen in FIG. 3, the air and foam solution lines meet at a venturi mixing unit 146. The flow of compressed air entering from the side of the venturi unit 146 creates a vacuum effect which picks up the foam solution entering from the bottom of the venturi, so that the two components are mixed and forced out the discharge side of the unit. From the venturi unit, the air/solution mixture enters the foam conditioner 64, which may be of any suitable type. In the embodiment which is illustrated, the conditioner is preferably a tubular chamber filled with a suitable medium for conditioning the bubble structure of the foam material flowing therethrough; suitable media, of which many are known to those skilled in the art, include masses of beads, steel wool, washers, nuts and bolts, gravel, and so forth.

From the foam conditioner the foam material passes through the foam hose 66 and (in the embodiment which is illustrated) to the intake side of the cellular grout pump 70. A check valve 148 is provided in the output line from the foam conditioner, so as to prevent grout from backing up through the foam hose into the panel when the foam output is secured.

The density of the finished foam material is thus adjusted by proportioning the flow rate of the foam solution (through line 56) relative to that of compressed air (through line 62). The density (sometimes referred to as the "weight") of the foam depends on the relative proportions of solution and air which are combined to form the material. In addition to weight, the foam solution/air ratio controls other characteristics of the finished foam material: A "heavier" finished foam material produces a stronger, more stable bubble structure, while a "lighter" material is less expensive owing to the lesser amount of solution which is required. For example, at one point in an operation it may be possible to use a lighter, less expensive foam material, while it may be necessary to increase the density of the foam so as to produce stronger materials as higher injection pressures are encountered.

Accordingly, to adjust the density of the finished foam during operation of the apparatus, the operator simply "dials in" an increase or decrease in the flow rate (GPM) of the foam solution relative to the flow rate of the air (CFM). To facilitate this operation, the operator may refer to a chart listing known ratios of solution to air (in terms of GPM/CFM) for predetermined densities of finished foam. To produce a heavier or lighter foam material while keeping the output rate constant, the operator then simply increases or decreases the drive speed of the solution metering pump 50 while holding the air flow rate constant, so as to increase/decrease the rate of flow of the foam solution relative to that of the air. The operator compares the flow rate readouts (43, 114) with the target readings provided by the chart, until the right spot is hit to produce the desired weight. By the same token, if an increase/decrease in foam output is required, but at the same density, the operator simply increases/decreases the speed of solution metering pump 50 while simultaneously opening/closing air metering valve 142, so as to simultaneously increase or decrease both flow rates while maintaining the same relative proportions.

d. Grout Mixing System

As was noted above, in the embodiment which is illustrated in FIGS. 1–4, the foam output is mixed with cement slurry to form a foamed cement grout product.

The use of the large-capacity, rotor-stator type pump 70 driven by a variable speed hydraulic motor 72 enables the flow of the cement slurry to be precisely adjusted. The operator is thus able to adjust relative rates between the foam generation system and the slurry pump so as to adjust the quality of the foamed cement grout. For example, the speed of the slurry metering pump 70 may be increased or decreased using control 144 while maintaining the foam input constant, so as to increase or decrease the ratio of foam to cement slurry and thereby change the density of the finished product. If it is desired to keep the grout output rate constant, then metering pump 70 may be maintained at a constant speed, while the flow rate of the finished foam material is increased/decreased as necessary.

e. Control and Monitoring System

FIG. 4 shows an enlarged view of portions of the control/monitoring layout of the apparatus of FIG. 3. As can be seen, the metering pump drive motors 111, 46, and 72, are equipped with shaft-mounted tachometer drives 150, 152, 154 and associated electronic pickup units 156, 158, 160, which provide readouts at digital tachometer displays 162, 164, 166 in panel 86. Panel 86 also includes digital readouts 170 and 172 for the foam concentrate and solution flow meters 114 and 43, and readouts 174 and 176 for the flow meters 45, 178 on the air supply and grout pump intake lines.

The speed of each of the drive motors 111, 46, 72 is controlled by the operator from panel 180 using speed control valves 110, 138 and 144. This configuration enables the operator to energize/de-energize the machine using the cutout valves 108, 136, 182 without having to disturb the adjustments every time; also, once the correct settings have been determined, the operator can turn the speed adjustment valves to the correct positions while the machine is in the stand-by mode, and then material having the correct proportions will be produced immediately as soon as the cutout valves are opened. The hydraulic pressure gauges 184, 186, 188 provide a back-up check to make sure that the hydraulic pressure is within the operating range of the motors and other equipment.

As the speed of the drive motor pumps is adjusted from panel 180, the tachometer displays in panel 86 permit the operator to closely monitor the speeds of the pumps, and to increase or decrease their speeds to accuracies within a fraction of revolution per minute. Since the flow rate of each pump is directly proportional to its rate of operation, the operator can be provided with a set of "target" speeds (based on calculations or experience) which have been determined will produce a material having approximately the correct proportions; these settings can then be adjusted or "fine-tuned" as necessary under operating conditions.

The actual flow rates at which the constituents are being delivered are verified by means of the flow meters. An exemplary flow meter which is eminently suitable for use in the system described above is the FLUMAG™ Electromagnetic Flow Meter, available from Schlumberger Industries, Inc., Measurement Division, Greenwood, S.C. Each of these flow meters has its own local display, plus the remote display in panel 86. The flow meters consequently provide a reading from which the proportions can readily be calculated and compared with a predetermined standard. Also, the flow meters provide an immediate visual indication if a problem affecting the quality of the material (e.g., a blockage in one of the supply lines) should develop. It will also be noted that the flow meter 178 is mounted on the intake side of the grout pump 70, because this is to measure the slurry flow and also because the operation of such a large pump may cause reading fluctuations if the flow meter is installed on the output side.

All of the controls and displays are preferably positioned together so as to enable a person to operate the controls while simultaneously watching the corresponding tachometer and flow meter readouts. Also, the operating levers for the cutout valves for the solution drive motor and air supply are exposed at the front of the panel and are linked together for operation using a single hand; this enables the operator to energize both supplies (i.e., the air and solution supplies) simultaneously with a single motion, so that finished foam having the correct proportions is produced at one.

In the embodiment which is illustrated, these controls/displays are configured for manual operation. It will be understood, however, that in some embodiments these controls may be automated; for example, the tachometer and flow meter readout data may be supplied to a microprocessor which automatically adjusts the speeds of the pump drives, through hydraulic or pneumatic controls, for example.

f. Applications

Figure 5:
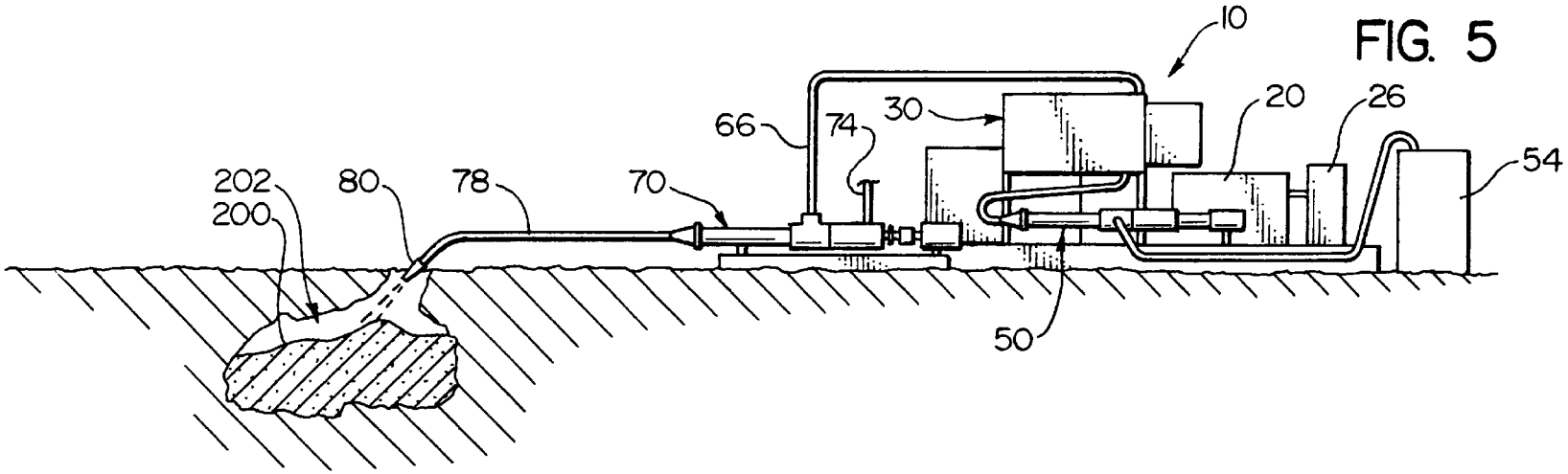
FIG. 5 is an environmental view showing the apparatus of FIGS. 1–2 supplying the foam outputted from the apparatus to a cement slurry mixing pump from which cellular cement foam is outputted to fill an exemplary subterranean void.

The apparatus of the present invention can be used to produce large quantities of finished foam material for any purpose where this is needed. For example, FIG. 5 shows the apparatus 10, as shown and described in FIGS. 1–2, being used to produce foamed cement grout 200 which is injected to fill a subterranean cavity 202. As was noted above, in this application the foam output hose 66 is connected to the intake side of a slurry mixing pump 70. The foam intake port is positioned a sufficient distance downstream of the cement slurry intake port 74 to prevent the foam from backing or "bubbling" up to the slurry intake during operation.

The quality of grout required may vary considerably from job to job. For example, some situations involve a large void fill which requires low compressive strength material and in which viscosity/flowability of the material may or may not be a factor; other jobs, such as the grouting of tunnel liners, involve much tighter spaces in which greater fluidity and/or compressive strength may be desired. The flexibility of the present invention allows the operator to adjust the quality of the material as necessary to meet these situations.

Figure 6:
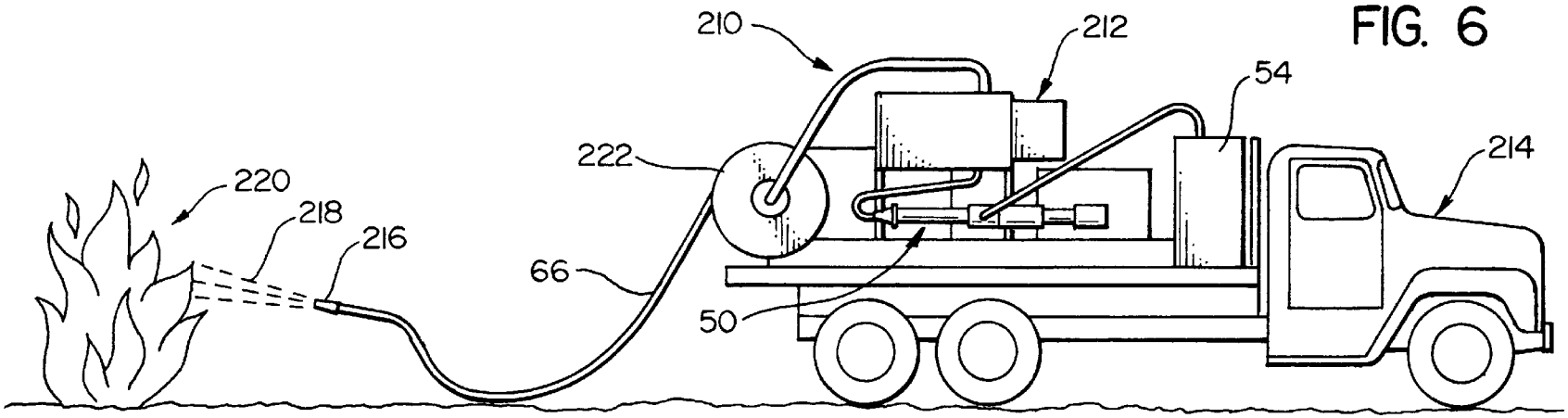
FIG. 6 is an environmental view showing the apparatus of FIGS. 1–2 mounted onboard a transport truck for mobile use as a fire fighting apparatus.

FIG. 6, in turn, shows a mobile fire fighting apparatus 210 comprising a foam generating apparatus 212 in accordance with the present invention mounted on a truck chassis 214. This enables the equipment to be transported to the scene of an aircraft crash or other fire site. In this embodiment the foam discharge hose 66 is connected to a nozzle 216, from which the finished foam material 218 is discharged onto the fire 220. The apparatus may include a hose reel 222 and other equipment known to those skilled in the art of fire fighting for particularly adapting the system to this use. Moreover, the foam solution in tank 54 may contain additives to enhance the effectiveness of the finished foam material for this purpose, and furthermore, metering pumps similar to those described above may be incorporated for proportionally mixing the solution and/or such additives.

It is to be recognized that various alterations, modifications, and/or additions may be introduced into the constructions and arrangements of parts described above without departing from the spirit or ambit of the present invention as defined by the appended claims.

What is claimed is:

1. An apparatus for continuous production of finished foam, said apparatus comprising:

supply means, comprising:

a positive displacement metering pump configured to deliver a substantially continuous flow of aqueous foam solution at a rate which is directly proportional to a rate of operation of said pump;

an air supply for delivering a substantially continuous flow of compressed air; and blending means for combining said aqueous foam solution which is delivered by said pump with compressed air which is delivered by said air supply, so as to form a finished foam material;

monitoring means, comprising:

means for monitoring a rate of flow at which said compressed air is delivered to said blending means by said air supply;

means for monitoring a rate of flow at which said foam solution is delivered to said blending means by said metering pump; and control means, comprising:

speed control means for selectively adjusting said rate of operation of said metering pump so as to proportionally adjust the amount of said foam solution which is delivered to said blending means; and means for selectively adjusting said rate of flow of said compressed air so as to proportionally adjust the amount of said compressed air which is delivered to said blending means.

2. The foam production apparatus of claim 1, wherein said metering pump comprises:

a positive-displacement, progressive-cavity, screw-type pump.

3. The foam production apparatus of claim 2, wherein said means for monitoring said rate of flow of said foam solution comprises:

a flow meter for providing a continuous reading of said rate of flow of said foam solution.

4. The foam production apparatus of claim 3, further comprising:

storage means for supplying premixed foam solution to said solution metering pump.

5. The foam production apparatus of claim 3, further comprising:

means for mixing foam concentrate and water in selected proportions to produce said foam solution, and for supplying said foam solution to said solution metering pump.

6. The foam production apparatus of claim 5, wherein said means for mixing said foam concentrate and water in selected proportions comprises:

a positive displacement foam concentrate metering pump for supplying a substantially continuous flow of foam concentrate through a concentrate supply line connected to an intake side of said solution metering pump, said concentrate metering pump being configured to deliver a rate of flow which is directly proportional to rate of operation thereof;

a water line also connected to said intake side of said solution metering pump, for supplying a substantially continuous flow of water thereto;

means for monitoring a rate of flow at which said foam concentrate is supplied by said concentrate metering pump; and speed control means for variably adjusting the rate of operation of said concentrate metering pump so as to proportionally adjust said rate of flow at which said foam concentrate is delivered to said solution metering pump;

whereby said selected proportions in which said foam concentrate and water are mixed to produce said foam solution are selectively adjustable by adjusting the relative rates of operation of said foam concentrate and solution metering pumps.

7. The foam production apparatus of claim 2, wherein said means for monitoring said rate of flow of said compressed air comprises:

a flow meter mounted in said air line for providing a continuous reading of said rate of flow of said compressed air.

8. The foam production apparatus of claim 2, wherein said means for variably adjusting said rate of operation of said foam solution metering pump comprises:

a variable speed hydraulic drive motor operably connected to said metering pump; and a speed adjustment valve for adjusting a flow of hydraulic pressure to said drive motor so as to variably control the speed thereof.

9. The foam production apparatus of claim 8, wherein said means for adjusting said rate of operation of said foam solution metering pump further comprises:

a cutout valve connected in series with said speed adjustment valve, so that said solution metering pump can be secured and started without disturbing said speed adjustment valve.

10. The foam production apparatus of claim 2, further comprising:

means for mixing said finished foam with cement slurry in selected proportions so as to form a foamed cement grout on a substantially continuous basis.

11. The foam generating apparatus of claim 10, wherein said means for mixing said finished foam with cement slurry comprises:

a positive displacement grout metering pump for receiving and mixing said finished foam and said cement slurry on a substantially continuous basis, said grout metering pump being configured to deliver a rate of flow which is directly proportional to the rate of operation thereof;

means for monitoring a rate of flow at which said cement slurry is drawn by said grout metering pump; and speed control means for variably adjusting the rate of operation of said grout metering pump so as to proportionally adjust said rate of flow at which said cement slurry is drawn by said grout metering pump relative to said rate at which said finished foam is supplied thereto from said foam blending means, so as to produce a foamed cement grout having selected proportions of said finished foam and cement slurry.

12. The foam generating apparatus of claim 11, wherein said grout metering pump comprises:

a positive-displacement, progressive-cavity, screw-type pump.

13. The foam production apparatus of claim 12, wherein said grout metering pump further comprises:

first and second spaced apart injection points for said finished foam and cement slurry on an intake side of said positive displacement, progressive-cavity screw-type pump.

14. The foam production apparatus of claim 13, wherein said first injection point for said finished foam is positioned a spaced distance downstream of said second injection point for said cement slurry on said intake side of said pump, said spaced distance being sufficient to prevent said finished foam from backing up to said second injection point during operation of said pump.

15. The foam production apparatus of claim 2, further comprising:

means for directing a substantially continuous flow of said finished foam onto a fire for extinguishment thereof.

16. The foam production apparatus of claim 15, wherein said means for directing said flow of finished foam onto a fire comprises:

a hose member having a first end connected to an output side of said foam blending means; and a nozzle member connected to a second end of said hose member for projecting said flow of finished foam onto a fire.

17. An apparatus for continuous production of finished foam, said apparatus comprising:

a positive-displacement, progressive-cavity, screw-type metering pump connected to a supply of liquid foam solution, said metering pump being configured to deliver said foam solution on a substantially continuous basis and at a rate of flow which is directly proportional to the rate of operation of said pump;

a flow meter for monitoring a rate of flow at which said foam solution is supplied by said metering pump;

a variable speed drive motor operably connected to said solution metering pumps;

speed adjustment means for selectively controlling the speed of said drive motor so as to selectively adjust said, rate at which said foam solution is delivered by said metering pump;

means for providing a flow of compressed air at a substantially constant pressure and on a substantially continuous basis;

a flow meter for monitoring a rate of flow of said compressed air;

valve means for selectively adjusting said rate of flow of said compressed air; and a conditioner for receiving and combining said flow of foam solution and said flow of compressed air so as to form a finished foam material on a substantially continuous basis;

whereby said rates at which said foam solution and air are supplied to said conditioner are proportionally adjustable by monitoring said rates of flow and selectively adjusting said air valve means and motor speed control so as to produce a finished foam material having selected proportions of said air and foam solution.

18. The apparatus of claim 17, wherein said metering pump drive motor comprises:

a variable speed hydraulic drive motor operably connected to said metering pump.

19. The apparatus of claim 18, wherein said speed adjustment means comprises:

a speed adjustment valve for selectively adjusting a flow of hydraulic pressure to said drive motor so as to variably control the speed thereof.

20. The apparatus of claim 19, wherein said speed adjustment means further comprises:

a cutout valve connected in series with said speed adjustment valve so that said solution metering pump can be secured and started without disturbing said speed adjustment valve.

21. The apparatus of claim 20, further comprising:

a hydraulic pump for supplying hydraulic pressure to said speed adjustment means; and prime mover means for driving said hydraulic pump.

22. The apparatus of claim 21, further comprising:

a framework to which all components of said apparatus are mounted so as to form an assembly which is transportable as a unit.

23. The apparatus of claim 22, further comprising:

a second positive-displacement, progressive-cavity, screw-type metering pump connected to a supply of cement slurry, said slurry metering pump being configured to mix said cement slurry with said finished foam to form a foamed cement grout material on a substantially continuous basis, and to deliver said foamed cement grout at a rate of flow which is directly proportional to the rate of operation of said slurry metering pump.

24. The apparatus of claim 23, wherein said slurry metering pump further comprises:

first and second spaced apart injection ports for said finished foam and cement slurry on an intake side of said progressive-cavity, screw-type pump.

25. The apparatus of claim 24, wherein said first injection port for said finished foam is positioned a spaced distance downstream of said second injection point for said cement slurry on said intake side of said pump, said spaced distance being sufficient to prevent said finished foam from backing up to said second injection point during operation of said pump.

26. The apparatus of claim 22, further comprising:

means for directing a substantially continuous flow of said finished foam onto a fire for extinguishment thereof.

27. An apparatus for production of finished foam, said apparatus comprising:

supply means, comprising:

a positive displacement metering pump configured to deliver a flow of aqueous foam solution at a rate which is directly proportional to a rate of operation of said pump;

an air supply for delivering a flow of compressed air; and blending means for combining said aqueous foam solution which is delivered by said pump with compressed air which is delivered by said air supply, so as to form a finished foam material;

monitoring means, comprising:

means for monitoring a rate of flow at which said compressed air is delivered to said blending means by said air supply;

means for monitoring a rate of flow at which said foam solution is delivered to said blending means by said metering pump; and control means, comprising:

speed control means for selectively adjusting said rate of operation of said metering pump so as to proportionally adjust the amount of said foam solution which is delivered to said blending means; and means for selectively adjusting said rate of flow of said compressed air so as to proportionally adjust the amount of said compressed air which is delivered to said blending means.

28. The foam production apparatus of claim 27, wherein said metering pump comprises:

a positive-displacement, progressive-cavity, screw-type pump.

29. The foam production apparatus of claim 27, wherein said means for monitoring said rate of flow of said foam solution comprises:

a flow meter for providing a reading of said rate of flow of said foam solution.

30. The foam production apparatus of claim 29, further comprising:

storage means for supplying premixed foam solution to said solution metering pump.

31. The foam production apparatus of claim 29, further comprising:

means for mixing foam concentrate and water in selected proportions to produce said foam solution, and for supplying said foam solution to said solution metering pump.

32. The foam production apparatus of claim 31, wherein said means for mixing said foam concentrate and water in selected proportions comprises:

a positive displacement foam concentrate metering pump for supplying a flow of foam concentrate through a concentrate supply line connected to an intake side of said solution metering pump, said concentrate metering pump being configured to deliver a rate of flow which is directly proportional to rate of operation thereof;

a water line also connected to said intake side of said solution metering pump, for supplying a flow of water thereto;

means for monitoring a rate of flow at which said foam concentrate is supplied by said concentrate metering pump; and speed control means for variably adjusting the rate of operation of said concentrate metering pump so as to proportionally adjust said rate of flow at which said foam concentrate is delivered to said solution metering pump;

whereby said selected proportions in which said foam concentrate and water are mixed to produce said foam solution are selectively adjustable by adjusting the relative rates of operation of said foam concentrate and solution metering pumps.

33. The foam production apparatus of claim 27, wherein said means for monitoring said rate of flow of said compressed air comprises:

a flow meter mounted in said air line for providing a reading of said rate of flow of said compressed air.

34. The foam production apparatus of claim 27, wherein said means for variably adjusting said rate of operation of said foam solution metering pump comprises:

a variable speed hydraulic drive motor operably connected to said metering pump; and a speed adjustment valve for adjusting a flow of hydraulic pressure to said drive motor so as to variably control the speed thereof.

35. The foam production apparatus of claim 34, wherein said means for adjusting said rate of operation of said foam solution metering pump further comprises:

a cutout valve connected in series with said speed adjustment valve, so that said solution metering pump can be secured and started without disturbing said speed adjustment valve.

36. The foam production apparatus of claim 27, further comprising:

means for mixing said finished foam with cement slurry in selected proportions so as to form a foamed cement grout.

37. The foam generating apparatus of claim 36, wherein said means for mixing said finished foam with cement slurry comprises:

a positive displacement grout metering pump for receiving and mixing said finished foam and said cement slurry, said grout metering pump being configured to deliver a rate of flow which is directly proportional to the rate of operation thereof;

means for monitoring a rate of flow at which said cement slurry is drawn by said grout metering pump; and speed control means for variably adjusting the rate of operation of said grout metering pump so as to proportionally adjust said rate of flow at which said cement slurry is drawn by said grout metering pump relative to said rate at which said finished foam is supplied thereto from said foam blending means, so as to produce a foamed cement grout having selected proportions of said finished foam and cement slurry.

38. The foam generating apparatus of claim 37, wherein said grout metering pump comprises:

a positive-displacement, progressive-cavity, screw-type pump.

39. The foam production apparatus of claim 38, wherein said grout metering pump further comprises:

first and second spaced apart injection points for said finished foam and cement slurry on an intake side of said positive displacement, progressive-cavity screw-type pump.

40. The foam production apparatus of claim 39, wherein said first injection point for said finished foam is positioned a spaced distance downstream of said second injection point for said cement slurry on said intake side of said pump, said spaced distance being sufficient to prevent said finished foam from backing up to said second injection point during operation of said pump.

41. The foam production apparatus of claim 27, further comprising:

means for directing a flow of said finished foam onto a fire for extinguishment thereof.

42. The foam production apparatus of claim 41, wherein said means for directing said flow of finished foam onto a fire comprises:

a hose member having a first end connected to an output side of said foam blending means; and a nozzle member connected to a second end of said hose member for projecting said flow of finished foam onto a fire.

* * * * *